US006165043A

United States Patent [19]

Terzian et al.

[11] Patent Number: 6,165,043

[45] Date of Patent: Dec. 26, 2000

[54] FOUR-LEGGED WALKING TOY WITH IMPROVED LEG ACTION

[75] Inventors: Rouben T. Terzian, Chicago, Ill.; Ali Nikkhah, Mission Viejo, Calif.

[73] Assignee: Mattel, Inc., El Segundo

[21] Appl. No.: 09/137,069

[22] Filed: Aug. 20, 1998

[51] Int. Cl.[7] ..... A63H 7/00

[52] U.S. Cl. ..... 446/356; 446/377

[58] Field of Search ..... 446/356, 354, 446/353, 330, 376, 377

[56] References Cited

U.S. PATENT DOCUMENTS

| | | |
|---|---|---|
| 61,416 | 1/1867 | Goodwin . |
| 469,169 | 2/1892 | Norton . |
| 637,508 | 11/1899 | Sanson et al. . |
| 1,422,436 | 7/1922 | Gorgellino . |
| 1,514,350 | 11/1924 | Sikora . |
| 1,538,140 | 5/1925 | Spelling . |
| 1,807,391 | 5/1931 | Danko et al. . |
| 2,135,783 | 11/1938 | Arnold . |
| 2,850,839 | 9/1958 | Bogart . |
| 3,010,729 | 11/1961 | Tomosy . |
| 4,177,602 | 12/1979 | Choi . |
| 4,228,615 | 10/1980 | Melotti . |
| 4,245,515 | 1/1981 | Iwaya . |
| 4,657,098 | 4/1987 | Wilcox . |
| 5,842,906 | 12/1998 | Terzian et al. . |

FOREIGN PATENT DOCUMENTS

| | | |
|---|---|---|
| 19504 | of 1893 | United Kingdom . |
| 370803 | 4/1932 | United Kingdom . |

*Primary Examiner*—Kien T. Nguyen
*Attorney, Agent, or Firm*—Roy A. Ekstrand

[57] ABSTRACT

A four-legged walking toy includes a body supported by four pivotally secured legs and a drive mechanism operative upon the legs which includes a pair of mirror image drive units each having three elliptical gears therein. The center elliptical gears of each drive unit are coupled in a one hundred eighty degree phase relationship to offset the operation of left legs from right legs correspondingly. A plurality of frictional members are positioned on the underside of the animal hooves to provide frictional engagement as the walking toy is pushed across a suitable surface. The rearward movement of each forwardly extended leg couples rotational power through the elliptical gear mechanisms to the remaining legs to provide a realistic motion profile.

4 Claims, 3 Drawing Sheets

43
59
44
64
40
58
42
10
62
55
52
65
35
57
50
60
66
51
56
63
67
34
33
53
54
15
61
32
30
31
22
17
23
16
18
19
21
20
28
27
25
24
26

43
60
44
63
65
55
32
40
42
41
50
10
51
23
54
35
61
34
53
31
30
22
20
21
27
26
24
25

FOUR-LEGGED WALKING TOY WITH IMPROVED LEG ACTION

FIELD OF THE INVENTION

This invention relates generally to walking toys and particularly to apparatus for providing the leg motion of the walking toy's legs.

BACKGROUND OF THE INVENTION

Walking toys are well known and well established in the toy art. Such toys have been provided which are both two-legged and four-legged and which often utilize a power source such as a battery-powered motor to drive the legs through a motion profile. For years, practitioners in the art have struggled to provide more realistic leg movement in both two-legged and four-legged toys. All too often, the results have been a succession of leg actions which best be described as "stilted" and which lack any realistic imitation of animal or human leg movement.

While some success has been achieved in two-legged toys, realistic leg action in four-legged toys replicating animals such as horses or the like is yet to be provided. This is due in part to the complexity of motion which four-legged animals utilize when walking. The level of complexity of leg motion increases dramatically from a two-legged toy to a four-legged toy. In a continuing effort to meet this need, practitioners in the toy arts have provided a virtually endless variety of leg moving mechanisms which are directed toward walking toys having four legs. For example, U.S. Pat. No. 61,416 issued to Goodwin sets forth an AUTOMATIC TOY showing an early attempt to provide appropriate leg motion for a horse using a plurality of gear and linkage mechanisms supported within the horse body and legs.

U.S. Pat. No. 469,169 issued to Norton sets forth a FIGURE TOY configured to resemble a horse and having four movable multiply articulated legs. An internal mechanism comprising a plurality of gear drives and linkages operates the multiply jointed legs of the figure toy.

U.S. Pat. No. 637,508 issued to Grimoin-Sanson and Allard set forth a ROUNDABOUT having a four-legged animal resembling a horse supported upon multiply articulated legs which in turn are coupled to a linkage and crank mechanism for pivotally moving the figure's legs.

U.S. Pat. No. 1,422,436 issued to Gorgellino sets forth a MOTION DEVICE FOR AUTOMATONS having a body resembling a horse supported by four legs which are multiply articulated and which are coupled to a gear driven linkage drive mechanism pivotally supported within the horse body.

U.S. Pat. No. 1,514,350 issued to Sikora sets forth a MECHANICAL HORSE having a horse body and head supported by four multiply articulated legs. A series of gear drives are coupled from a common power shaft to each of the legs for motion thereof.

U.S. Pat. No. 1,538,140 issued to Spelling sets forth a WALKING ANIMAL having a horse-like body supporting four independently movable legs. The legs are not articulated but are coupled instead through a pivotal attachment to a gear drive mechanism which synchronizes the front to back movement of the legs.

U.S. Pat. No. 1,807,391 issued to Danko, et al. sets forth a WALKING TOY ANIMAL having a body resembling a horse supported by four movable legs each coupled to crank mechanisms, the relative motions of the legs being determined by the gear drive mechanism.

U.S. Pat. No. 2,135,783 issued to Arnold sets forth a MECHANICAL TOY IMITATING A CALCULATING HORSE having a horse supporting a movable front leg which is coupled to an incrementing counter intended to perform the illusion of the horse counting.

U.S. Pat. No. 2,850,839 issued to Bogart sets forth a WALKING ANIMAL TOY having multiply jointed legs supporting a flexible cord maintained in tension between the animal's hoof and the drive mechanism for moving the legs.

U.S. Pat. No. 3,010,729 issued to Tomosy sets forth a TOY WALKING FOUR-LEGGED ANIMAL having a horse-like body supported by four pivotally actuated legs. The pivoting supports of the individual legs are coupled to cam followers which in turn are driven by a grooved cam rotated to move the legs in accordance with a predetermined profile.

U.S. Pat. No. 4,228,615 issued to Melotti sets forth a SMALL-SIZE TOY ANIMAL HAVING ARTICULATED LIMBS in which a pair of front limbs and a pair of hind limbs are secured in an articulated attachment to the trunk of the toy animal. In each limb pair, the limbs are joined to each other by a respective horizontal axis cylindrical stem.

U.S. Pat. No. 4,245,515 issued to Iwaya sets forth a DEVICE FOR SWITCHING POWER OF ACTIVE TOY having a pair of drive gears including engaging lugs formed on their opposite inner surfaces for mutual engagement and crank portions for actuating predetermined acting portions.

U.S. Pat. No. 4,657,098 issued to Wilcox sets forth a HOBBY HORSE having an electrical power system supported therein which rotates a wheel coupled in an eccentric fashion to a pair of pivotal elements for each left and right leg pair of a four-legged animal.

British Patent 19505 and British Patent 370803 set forth early attempts to provide motion of four-legged animals such as a horse.

U.S. Pat. No. 4,177,602 issued to Choi sets forth an AUTOMATED MECHANISM FOR IMPARTING MOVEMENT TO LIMBS OF A MECHANICAL TOY having a two-legged and four-legged embodiment. In both embodiments, the legs are multiply articulated and include a push rod extending downwardly from an internal drive mechanism with an eccentric coupling to the push rod whereby the reciprocal motion of the push rod bends the hip and knee portions of the articulated legs to provide a realistic movement pattern.

While the foregoing described prior art devices have improved the art and in some instances enjoyed commercial success, there remains nonetheless a continuing need in the art for evermore improved, interesting and realistic leg moving apparatus for use in four-legged animals.

SUMMARY OF THE INVENTION

Accordingly it is a general object of the present invention to provide an improved walking toy. It is a more particular object of the present invention to provide an improved walking toy which exhibits a realistic and believable leg motion and which may be manufactured without undue complexity or expense.

In accordance with the present invention, there is provided a walking toy comprising: an animal body having an internal cavity; a first plurality of elliptical gears and a gear support; a first pair of links each having one end pivotally coupled to one of the first plurality of elliptical gears and a remaining end; a first pair of eccentric wheels each coupled to the one of the elliptical gears and to one of the first pair of links; a first pair of legs each having a sliding pivot attachment to the gear support and having a first pivotal attachment to the legs below the sliding pivot and to the remaining end of the links; second plurality of elliptical gears and a gear support; a second pair of links each having one end pivotally coupled to one of the second plurality of elliptical gears and a remaining end; a second pair of eccentric wheels each coupled to the one of the elliptical gears and to one of the second pair of links; a second pair of legs each having a sliding pivot attachment to the gear support and having a second pivotal attachment to the legs below the sliding pivot and to the remaining end of the links, the first and second plurality of elliptical gears including one gear from each plurality coupled in a fixed relationship.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
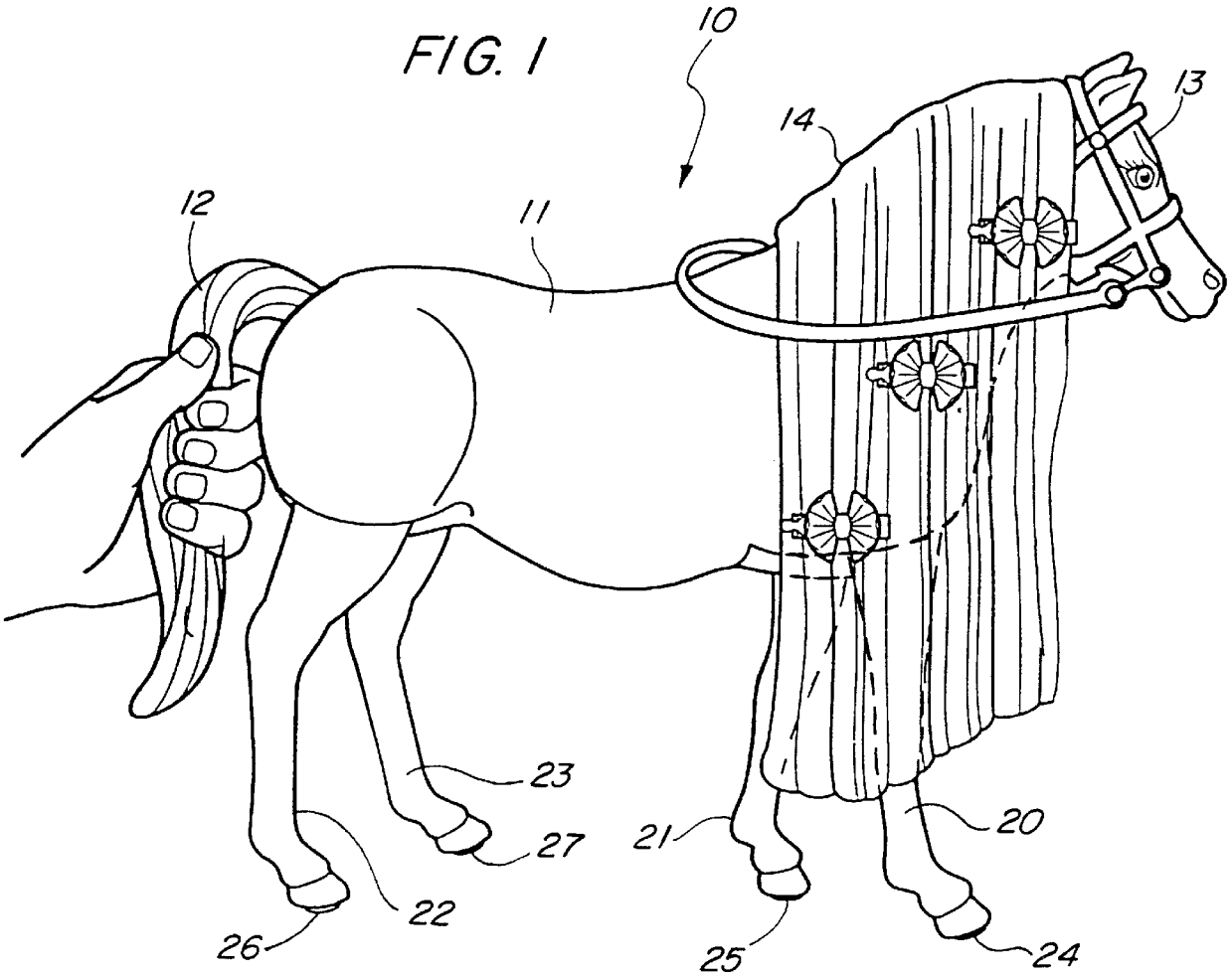
FIG. 1 sets forth a side elevation view of a toy horse constructed in accordance with the present invention.

FIG. 1 sets forth a side elevation view of a walking toy constructed in accordance with the present invention and generally referenced by numeral 10. Toy 10 is configured to resemble a horse and includes a body 11 supporting a tail 12, a head 13, a neck 14, a quartet of legs 20, 21, 22 and 23. By means set forth below in FIGS. 3 and 4, legs 20 through 23 are pivotally supported with respect to body 11. Legs 20 through 24 each terminate in a friction material hoof 24 through 27 on the underside of each hoof of legs 20 through 23. The function of frictional hooves is described below in greater detail. However, suffice it to note here that frictional hooves 24 through 27 are used to engage a walking surface as walking toy 10 is operated.

Figure 2:
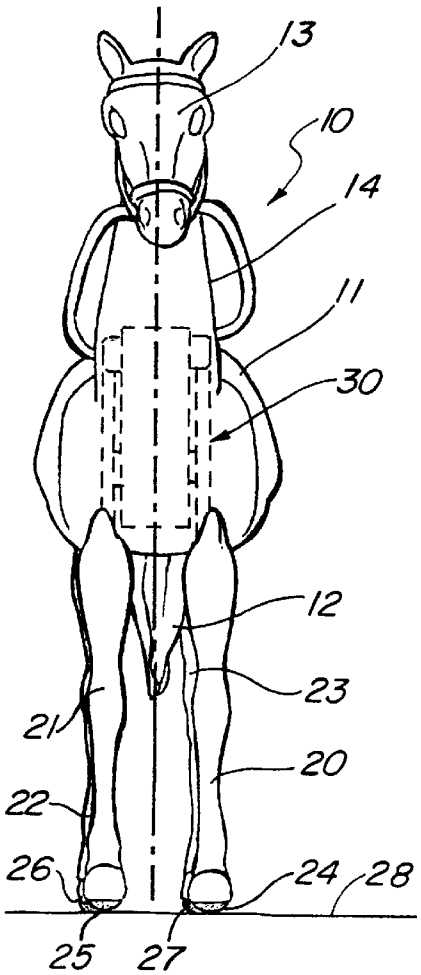
FIG. 2 sets forth a front view of the present invention toy horse.

In accordance with the anticipated operation of the present invention toy, the user may grasp body 11 or tail 12 in the manner shown and push forwardly against walking toy 10. In accordance with the leg moving and motion synchronizing apparatus of the present invention set forth below in greater detail, legs 20 through 23 cycle through a movement sequence which presents an unusually realistic and believable leg motion for walking toy 10. It will be understood that while walking toy 10 is shown in FIGS. 1 and 2 to provide a horse, the present invention is by no means limited to any particular four-legged animal. Accordingly, a variety of different four-legged animals may be operated using the present invention leg movement mechanism without departing from the spirit and scope of the present invention. Thus, walking toy 10 is able to maintain realistic leg movements without the need for interior power apparatus by simply pushing toy 10 across a surface which hooves 24 through 27 are capable of frictionally engaging. The operative mechanism of the present invention is set forth below in greater detail. However, suffice it to note here that the energy required for moving the various legs within toy 10 is provided by each of the four legs and their frictional engagement with the walking surface at different times during the operative cycle of the leg action mechanism. In particular as toy 10 is pushed forwardly, the force communicated to each leg as it goes through its stroke from its forwardmost position to its rearmost position provides torsional power operatively coupled by means set forth below in greater detail to the leg action apparatus.

FIG. 2 sets forth a front view of walking toy 10 having a head 13 supported by a neck 14 upon a body 11. Toy 10 further includes a plurality of legs 20 through 23 supported upon frictional hooves 24 through 27. Also seen in FIG. 2 is tail 12 of horse 10 which extends downwardly in the manner seen in FIG. 1.

In accordance with the present invention, body 11 supports a drive unit 30 which is described below in FIGS. 3 through 6. However, suffice it to note here that drive unit 30 is operatively coupled to each of legs 20 through 23 in the manner described below to synchronize and operate the leg motions of toy 10.

Figure 3:
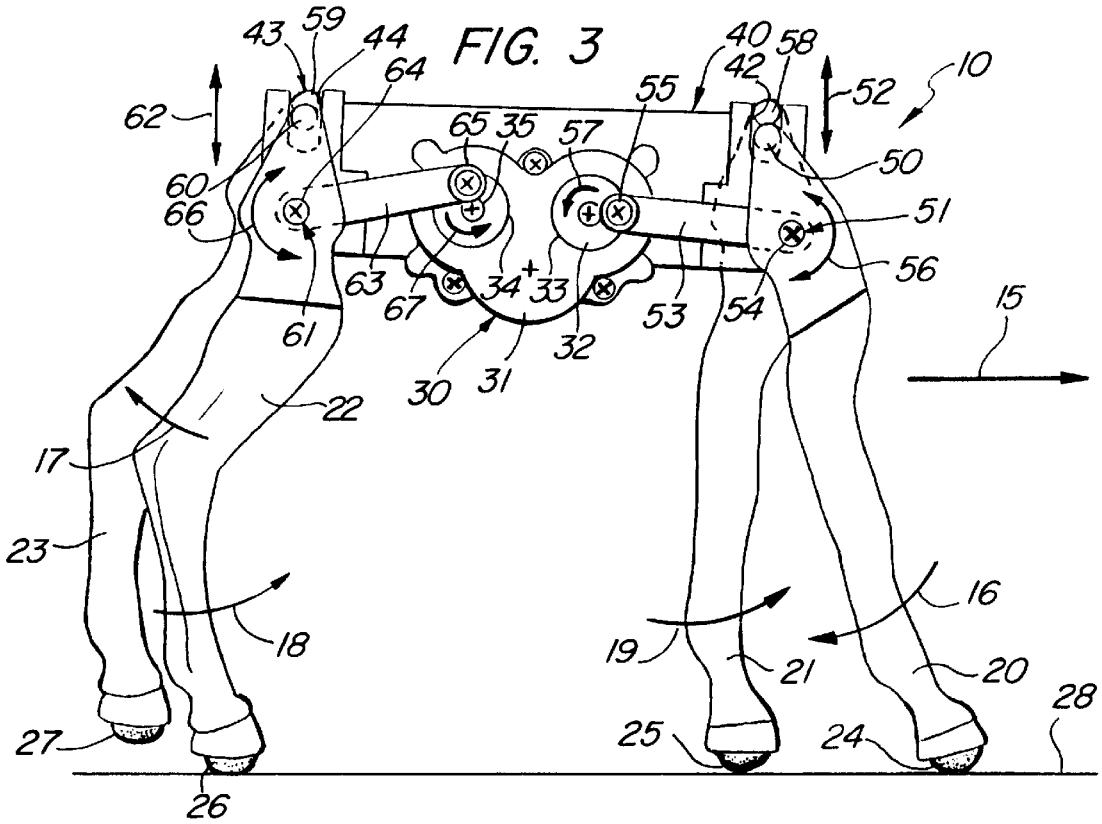
FIG. 3 sets forth a side view of the operative drive for the present invention walking toy having the body components removed therefrom and showing a first portion of the leg movement cycle.

FIG. 3 sets forth a side elevation view of drive unit 30 coupled to legs 20 through 23 of walking toy 10. For purposes of illustrating the operation of legs 20 through 23 together with drive unit 30, the entire body has been removed from the drawing of FIG. 3. It will be noted with return to FIG. 2, however, that drive unit 30 is supported within the interior of body 11.

More specifically, walking toy 10 includes a leg support 40 having a plurality of vertical slots 41, 42, 43 and 44 (seen in FIG. 6) formed at the end portions thereof. Leg support 40 further supports a drive unit 30 having a right housing 31 within which a trio of elliptical gears are supported in the manner seen in FIG. 5. Right housing 31 further supports a pair of eccentric wheels 32 and 34 which by means set forth below in greater detail are rotatably supported upon right housing 31. An elliptical gear mechanism, seen in FIG. 5 in greater detail, operatively couples eccentric wheel 32 to eccentric wheel 34 in a complex motion profile drive. In addition, a pivot 55 offset from the center 33 of elliptical wheel 32 is coupled to one end of a link 53. Similarly, a pivot 65 couples one end of link 63 to eccentric wheel 34 in an offset coupling.

Leg 10 includes a frictional hoof 24 on the lower end thereof and a pivot pin 50 on the upper end thereof. Pivot pin 50 is slidably received within slot 42 formed in leg mechanism support 40. An intermediate pivot attachment 51 provided by a fastener 54 secures link 53 to leg 20 below pivot pin 50. Leg 21 having a frictional hoof 25 is secured in substantially the same manner on the reverse side of leg support 40. Thus, leg 21 includes a pivot pin 58 slidably supported within slot 41 of leg mechanism support 40.

Walking toy 10 further includes a leg 22 having a frictional hoof 26 slidably supported within slot 44 of leg mechanism support 40 by a pivot pin 60. A link 63 is pivotally secured to pivot attachment 61 using a fastener 64.

Thus, leg 22 is secured in a substantially mirror image to leg 20. Toy 10 includes a leg 23 having a frictional hoof 27 slidably coupled to leg mechanism support 40 by a pivot pin 59 slidably received within slot 43 of leg mechanism support 40.

As is better seen below in FIGS. 5 and 6, it will be understood that drive unit 30 includes a left housing 36 (seen in FIG. 5) on the opposite side of leg mechanism support 40. It will be understood by those skilled in the art that left housing 36 supports an identical set of three elliptical gears assembled in the manner shown in FIG. 5. It will be further understood in connection with the descriptions of FIG. 5 that the center elliptical gears on each side of leg mechanism support 40 are secured for common rotation about a common center in a one hundred eighty degree offset. Suffice it to note here that a direct coupling exists between the gear mechanism driving legs 20 and 22 and gear mechanism driving legs 21 and 23.

In operation as toy 10 is pushed in a forward direction indicated by arrow 15, legs 20 through 23 are frictionally engaged upon surface 28 by frictional hooves 24 through 27 at different times in the operative cycle. Thus, for example, in the position shown in FIG. 3, the initiation of forward motion causes forwardly extended leg 20 to grip surface 28 and pivot rearwardly in the direction indicated by arrow 16. At this point in the cycle, leg 20 is in essence providing rotational power for the remainder of leg moving mechanisms within toy 10. Correspondingly, as leg 20 pivots rearwardly, leg 21 is pivoted forwardly in the direction indicated by arrow 19. Simultaneously, leg 22 is pivoted forwardly in the direction indicated by arrow 18 while leg 23 is pivoted rearwardly. The operative cycle continues as each leg is moved to a forward position at which time it becomes the motivation or power providing leg for the drive mechanism. The elliptical gear drive system shown in FIG. 5 provides an unusual leg movement action in that each leg moves through portions of its operative cycle relatively slowly while moving quickly at certain critical points in the operative cycle.

Figure 4:
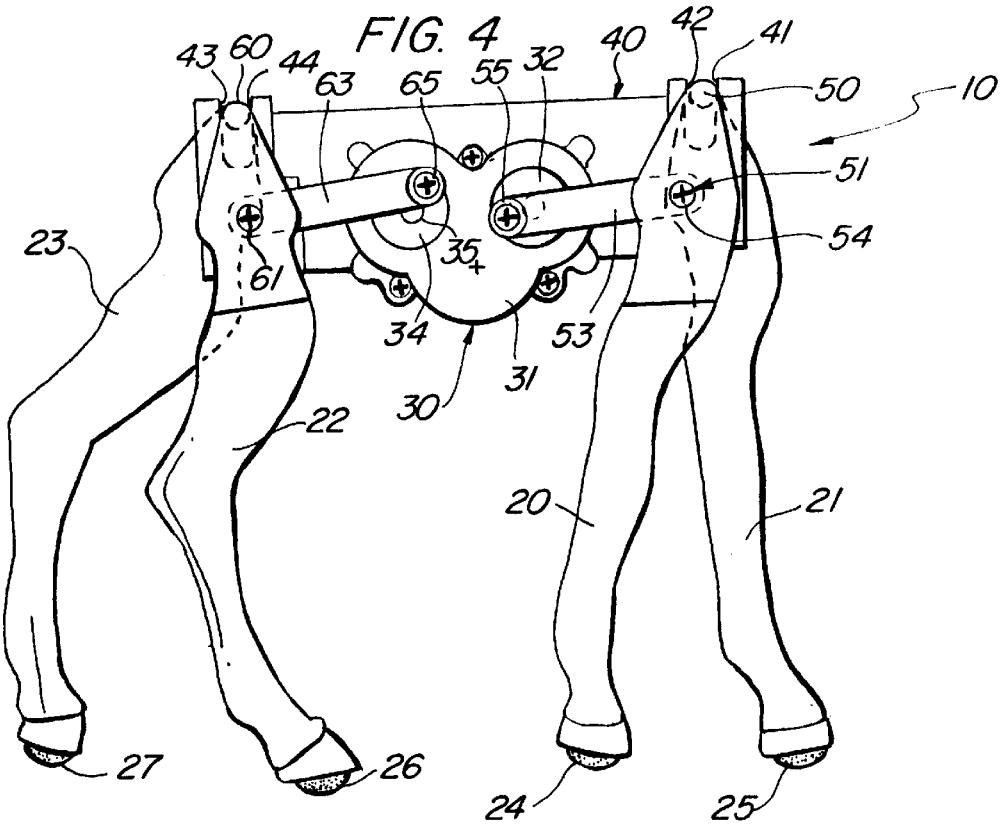
FIG. 4 sets forth the mechanism of FIG. 3 at a different point in the operative cycle of the four legs.

FIG. 4 sets forth the apparatus shown in FIG. 1 at a different point in its operative cycle. It will be seen that as the legs have moved, the right rear and right front leg have come together while the left front and left rear leg have moved apart. This is a realistic duplication of a horse's walking action.

More specifically, walking toy 10 includes a leg support 40 having a plurality of vertical slots 41, 42, 43 and 44 (seen in FIG. 6) formed at the end portions thereof. Leg support 40 further supports a drive unit 30 having a right housing 31 within which a trio of elliptical gears are supported in the manner seen in FIG. 5. Right housing 31 further supports a pair of eccentric wheels 32 and 34 which by means set forth below in greater detail are rotatably supported upon right housing 31. An elliptical gear mechanism, seen in FIG. 5 in greater detail, operatively couples eccentric wheel 32 to eccentric wheel 34 in a complex motion profile drive. In addition, a pivot 55 offset from the center 33 of elliptical wheel 32 is coupled to one end of a link 53. Similarly, a pivot 65 couples one end of link 63 to eccentric wheel 34 in an offset coupling.

Leg 10 includes a frictional hoof 24 on the lower end thereof and a pivot pin 50 on the upper end thereof. Pivot pin 50 is slidably received within slot 42 formed in leg mechanism support 40. An intermediate pivot attachment 51 provided by a fastener 54 secures link 53 to leg 20 below pivot pin 50. Leg 21 having a frictional hoof 25 is secured in substantially the same manner on the reverse side of leg support 40. Thus, leg 21 includes a pivot pin 58 slidably supported within slot 41 of leg mechanism support 40.

Walking toy 10 further includes a leg 22 having a frictional hoof 26 slidably supported within slot 44 of leg mechanism support 40 by a pivot pin 60. A link 63 is pivotally secured to pivot attachment 61 using a fastener 64. Thus, leg 22 is secured in a substantially mirror image to leg 20. Toy 10 includes a leg 23 having a frictional hoof 27 slidably coupled to leg mechanism support 40 by a pivot pin 59 slidably received within slot 43 of leg mechanism support 40.

As is better seen below in FIGS. 5 and 6, it will be understood that drive unit 30 includes a left housing 36 (seen in FIG. 5) on the opposite side of leg mechanism support 40. It will be understood by those skilled in the art that left housing 36 supports an identical set of three elliptical gears assembled in the manner shown in FIG. 5. It will be further understood in connection with the descriptions of FIG. 5 that the center elliptical gears on each side of leg mechanism support 40 are secured for common rotation about a common center in a one hundred eighty degree offset. Suffice it to note here that a direct coupling exists between the gear mechanism driving legs 20 and 22 and gear mechanism driving legs 21 and 23.

The leg action through a complete cycle may be described as follows and assuming that walking toy 10 starts from an initial position in which left front leg 21 and left rear leg 23 are brought together while right front leg 20 and right rear leg 22 are moved apart. With legs 20 through 23 positioned in this manner, the user pushes forward upon walking toy 10 causing leg 20 to be moved rearwardly and causing leg 21 to move forwardly. As the forward push continues, leg 20 continues moving rearwardly while leg 22 moves forwardly in a quick movement. At the midpoint of an operative cycle characterized by the full rearward movement of leg 20, the leg orientations have reversed and legs 20 and 22 are now positioned together while legs 21 and 23 are spaced apart. As the user continues to push forwardly upon walking toy 10, the cycle reverses with leg 21 being moved rearwardly while leg 20 moves forwardly. As leg 21 continues to move rearwardly and the user continues to push against walking toy 10, leg 23 undergoes a rapid snap motion forwardly completing the operative cycle of leg motion. At the completion of the cycle, the leg positions have returned to their starting orientation in which legs 20 and 22 are separated or apart and legs 21 and 23 are together. This cycle continues as the user continues pushing walking toy 10 across a surface suitable for frictionally engaging the frictional hooves of the toy figure's legs. Surfaces such as glass tabletops, tile floors, or tile countertops have proven to be excellent surfaces for utilizing the present invention walking toy.

Figure 5:
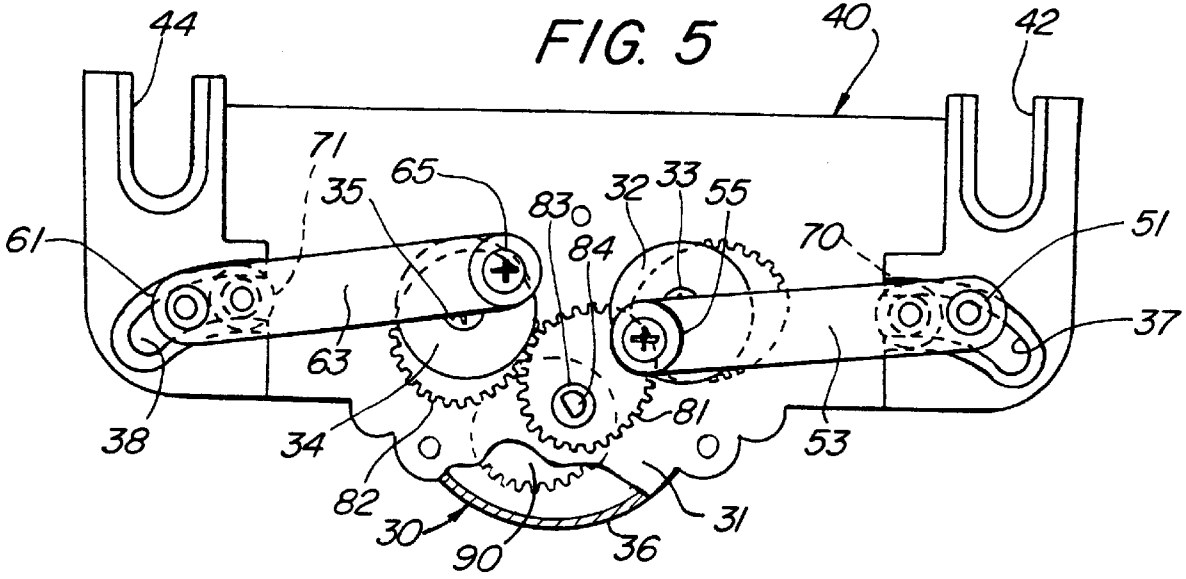
FIG. 5 sets forth a side view of the gear drive mechanism of the present invention walking toy.

FIG. 5 sets forth a partially sectioned view of drive unit 30 formed of right housing 31 and left housing 36. Drive unit 30 is secured to a leg mechanism support 40 having slots 42 and 44 together with slots 41 and 43 (seen in FIG. 6) formed in the end portions thereof. Leg mechanism support 40 further defines a pair of downwardly curved slots 37 and 38 which receive a pair of pivots 70 and 71. In accordance with the present invention, drive unit further includes a trio of elliptical gears 80, 81 and 82 supported upon leg mechanism support 40 in the manner shown in FIG. 5. Elliptical gear 80 is secured to a wheel 32 in an offset attachment by a fastener 33. Wheel 32 is secured to one end of a link 53 by a pivot 55. As is better seen in FIGS. 3 and 4, the remaining end of link 53 is secured to leg 20 by a pivot 51. In addition, pivot pin 70 movable within curved slot 37 is joined to link 53.

In a similar manner, elliptical gear 82 is secured to wheel 34 in an offset attachment using fastener 35. Wheel 34 is pivotally coupled to link 63 by a pivot 65. The remaining end of link 63 is secured to a pivot 71 movable within curved slot 38. As is set forth above in FIGS. 3 and 4, the remaining end of link 63 is pivotally secured to leg 22 by a pivot 61.

Finally, elliptical gear 80 is supported by a shaft 83 having a flatted shaft portion 84 and engages gears 80 and 82. In addition and in accordance with an important aspect of the present invention, shaft 80 and flatted portion 84 pass through an aperture formed in leg mechanism support 40 and are secured to an elliptical gear 90 which is positioned on the back side of leg mechanism support 40. In further accordance with the present invention, the coupling between gear 81 and gear 90 is offset by one hundred eighty degrees.

While not seen in FIG. 5, it will be understood that drive unit 30 includes an identical arrangement to that shown in FIG. 5 on the opposite side of leg mechanism support 40. The only difference between the drive mechanism on the opposite of leg mechanism support 40 and the drive mechanism provided by elliptical gears 80, 81 and 82 is the angular relationship between gears 81 and 90. Thus, rotational power provided in the above-described walking cycle is operatively coupled between elliptical gear 81 and elliptical gear 90 which form respective drive gears for operating the above-described leg motion. It will be further understood by those skilled in the art that the identical drive mechanism on the reverse side of leg mechanism support 40 housed within left housing 36 is operatively coupled to legs 21 and 23 in the identical manner shown in FIG. 5.

Figure 6:
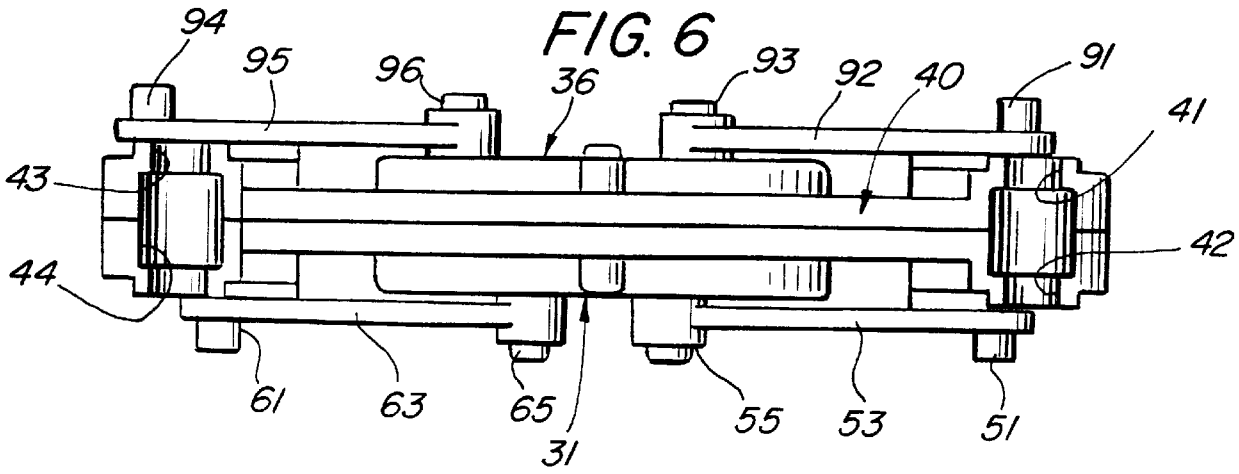
FIG. 6 sets forth a top view of the drive apparatus and leg support apparatus of the present invention with the body and legs removed therefrom.

FIG. 6 sets forth a top view of the drive mechanism and leg mechanism support of the present invention having the legs removed therefrom. Leg mechanism support 40 supports a pair of slots 41 and 42 at one end and a pair of slots 43 and 44 at the remaining end. A right housing 31 is secured to leg mechanism support 40 and supports the drive mechanism described above provided by elliptical gears 80, 81 and 82 together with eccentric wheels 32 and 34 (seen in FIG. 5). Similarly, leg mechanism support 40 supports a left housing 36 within which a corresponding trio of elliptical gears and wheels substantially identical to gears 80 through 82 and wheels 32 and 34 is supported.

A pivot 55 secures wheel 32 (seen in FIG. 5) to a link 53, the remaining end of which forms a pivot 51 which as is seen in FIG. 4 is coupled to leg 20. Similarly, a pivot 65 secures link 63 to wheel 34 in the manner shown in FIG. 5 while a pivot 61 secures the remaining end of link 63 to leg 22 in the manner shown in FIG. 4.

In an identical mirror image structure, housing 36 supports a plurality of elliptical gears as mentioned above which are coupled to pivots 93 and 96 by a pair of eccentric wheels identical to wheels 32 and 34 (seen in FIG. 5). A pair of links 92 and 95 are substantially identical to links 53 and 63 shown in FIG. 5 and are coupled to legs 21 and 23 by pivots 91 and 94 respectively. The resulting drive mechanism shown in FIG. 6 is symmetrical and mirror image on both sides of leg support 40. As a result, the motion profile applied to legs 21 and 23 is offset from the motion profile of legs 20 and 22 due to the one hundred eighty degree relationship between elliptical gear 81 and elliptical gear 90 on each side of leg mechanism support 40 which couples each of the mirror image drives.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. A walking toy comprising:

an animal body having an internal cavity and a first pair of legs one side of said body and a second Pair of legs on the opposed side of said body;

a first a pair of elliptical gears and a gear support;

a first pair of eccentric wheels each coupled to one of said elliptical gears in said first pair of elliptical gears;

a first pair of links each having one end pivotally coupled to one of said first a pair of eccentric wheels and a remaining end;

a first pair of sliding pivot attachments attaching said first pair of legs to said gear support and a first pair of pivotal attachments attaching said first pair of legs below said sliding pivot attachments to said remaining ends of said first pair of links;

a second pair of elliptical gears and a gear support;

a second pair of eccentric wheels each coupled to one of said elliptical gears in said second pair of elliptical gears;

a second pair of links each having one end pivotally coupled to one of said second pair of eccentric wheels and a remaining end;

a second pair of legs each having a sliding pivot attachments attaching said second pair of legs to said gear support and a second pair of pivotal attachments attaching said second pair of legs below said sliding pivot attachments to said remaining ends of said second pair of links;

a first elliptical coupling gear engaging said first pair of elliptical gears;

a second elliptical coupling gear engaging said second pair of elliptical gears; and a transverse shaft coupling said first and second of elliptical coupling gears together in a fixed relationship.

2. The walking toy set forth in claim 1 wherein said fixed relationship is one hundred eighty degrees out of phase.

3. The walking toy set forth in claim 2 wherein said first and second elliptical coupling gears are each the center gear of its trio.

4. The walking toy set forth in claim 3 wherein said first pair of legs is a first front and a first rear leg and wherein said second pair of legs is a second front a second rear leg and wherein said first pair of legs alternate between apart and together positions and said second pair of legs alternate out of phase with said first pair of legs between apart and together positions.

* * * * *